US006105833A

United States Patent [19]

Najarian

[11] Patent Number: 6,105,833

[45] Date of Patent: Aug. 22, 2000

[54] HANGER FOR A PRE-TIED NECKTIE ASSEMBLY

[76] Inventor: John Najarian, c/o Eastern Creative Industries, Inc. 257 Herbert Ave., Closter, N.J. 07624

[21] Appl. No.: 09/375,570

[22] Filed: Aug. 16, 1999

[51] Int. Cl.[7] ..... A47G 25/14

[52] U.S. Cl. ..... 223/85; 223/82

[58] Field of Search ..... 223/85, DIG. 1, 223/1; 2/145, 144, 148

[56] References Cited

U.S. PATENT DOCUMENTS

| | | | |
|---|---|---|---|
| D. 202,316 | 9/1965 | Pehr . | |
| D. 209,434 | 11/1967 | Jamison . | |
| 2,514,501 | 7/1950 | Macia et al. | 223/DIG. 1 |
| 3,085,725 | 4/1963 | Caparosa | 223/DIG. 1 |
| 3,118,541 | 1/1964 | McKeever et al. | 223/DIG. 1 |
| 3,123,331 | 3/1964 | Field et al. . | |
| 3,168,197 | 2/1965 | Sconza | 223/DIG. 1 |
| 3,385,486 | 5/1968 | Finan . | |
| 3,710,996 | 1/1973 | Smilow et al. . | |
| 4,063,669 | 12/1977 | Smilow et al. . | |
| 4,337,539 | 7/1982 | Najarian . | |
| 4,714,156 | 12/1987 | Kolton et al. . | |
| 4,930,692 | 6/1990 | Smilow et al. . | |
| 5,005,741 | 4/1991 | Kolton et al. . | |
| 5,421,494 | 6/1995 | Kolton et al. . | |
| 5,429,284 | 7/1995 | Kolton et al. . | |
| 5,505,351 | 4/1996 | Najarian | 223/85 |
| 5,556,014 | 9/1996 | Kolton et al. . | |
| 5,584,075 | 12/1996 | Bae et al. | 2/144 |
| 5,626,268 | 5/1997 | Kolton et al. | 223/85 |

FOREIGN PATENT DOCUMENTS

| | | | |
|---|---|---|---|
| 11912249 | 10/1959 | France | 2/145 |
| 485373 | 6/1955 | Italy | 2/145 |

*Primary Examiner*—Bibhu Mohanty
*Attorney, Agent, or Firm*—McAulay Nissen Goldberg & Kiel, LLP

[57] ABSTRACT

A hanger for a pre-tied knotted necktie assembly includes an upper hook portion, a central body portion coupled to the upper hook portion, and a lower stem portion coupled to the central body portion. The lower stem portion includes an opening therethrough that is adapted to receive and selectively retain the pre-tied knotted necktie assembly's clip. To connect the hanger to a necktie assembly, the necktie assembly's clip is disengaged, the necktie assembly and hanger are aligned at right angles relative to one another, the necktie assembly's clip is slid through the opening in the hanger's lower stem portion, the hanger and necktie assembly are turned relative to one another to place them in alignment, and the necktie assembly's clip is engaged.

11 Claims, 4 Drawing Sheets

HANGER FOR A PRE-TIED NECKTIE ASSEMBLY

BACKGROUND OF THE INVENTION

This invention relates in general to a hanger for a pre-tied knotted necktie assembly and, in particular, to a hanger which is rigidly connected to the necktie assembly for purpose of display and yet is readily removable therefrom by the customer without the use of tools.

Pre-tied knotted necktie assemblies typically are connected to a hanger and displayed at the place of sale in a hanging position. An example of such necktie assembly is shown in U.S. Pat. No. 4,337,539, issued Jul. 6, 1982, entitled Necktie Knot Support Assembly, and owned by the applicant of the present invention. An improvement upon such necktie assembly is shown in application Ser. No. 09/124,382, filed Jul. 28, 1998, now U.S. Pat. No. 6,021,522, issued Feb. 8, 2000 and likewise owned by the applicant herein. The necktie assembly of U.S. Pat. No. 4,337,539 includes a necktie, a knot support on which the necktie is pre-tied to form a necktie knot, and a clip for removably mounting the necktie assembly onto the neckband of a shirt collar. The assembly together with the hanger are sold to a vendor for resale to the customer. The hanger is used by the vendor to display the assembly. The hanger is intended to be separated from the assembly by the customer after the purchase is made.

U.S. Pat. No. 5,505,351, issued Apr. 9, 1996, entitled hanger for a pre-tied necktie assembly and owned by the applicant herein describes, claims a security type hanger that securely engages the necktie assembly whereby the customer may disengage the necktie assembly from the hanger after the purchase thereof. Another such type of security hanger is U.S. Pat. No. 5,556,014.

Retail stores, however, are in need of a hanger that rigidly retains a pre-tied knotted necktie assembly without actually securing the assembly thereto so that the customer can remove the hanger from the necktie assembly in the retail store for the purposes of trying on the necktie assembly. While a hanger exists that simply provides an enlarged round hole from which a clip-on tie assembly may hang, no hanger exists that rigidly retains a pre-tied knotted necktie assembly. Stores now utilize the type of hanger that is used for displaying an unknotted necktie, that is, a necktie which is not pre-tied. This type of hanger has been utilized for many years. As is well know, such hanger has two slots, formed by three horizontal plastic slats, through which passes portions of the unknotted tie so that the tie hangs in a folded-over position. One of the plastic slats may include a rectangular opening therein through which the clip of a pre-tied knotted necktie assembly may pass. Use of hangers meant for unknotted neckties also for knotted necktie assemblies is convenient and inexpensive. However, there remains the undesirable result that pre-tied necktie assemblies easily fall off these hangers by reason of the hangers breaking or the clips simply disengaging from the hangers' openings. Also, pre-tied necktie assemblies held by such conventional hangers provide an unaesthetic appearance.

OBJECTS AND SUMMARY OF THE INVENTION

It is therefore an object of the present invention to provide a hanger which overcomes the above-stated drawback of existing designs.

Another object of the present invention is to provide a hanger that accomplishes the above stated purposes while providing an aesthetically pleasing result.

A further object of the present invention is to provide a hanger that is easy and economical to manufacture.

In accordance with one embodiment of the present invention, a hanger for a pre-tied knotted necktie assembly includes an upper hook portion, a central body portion coupled to the upper hook portion, and a lower stem portion coupled to the central body portion that includes an opening therethrough that is adapted to receive and selectively retain the pre-tied knotted necktie assembly's clip.

As an aspect of the present invention, the opening through the hanger's lower stem portion is sized to receive the clip when the clip is disposed sideways relative to the hanger and then to retain the clip when the clip and hanger are rotated 90° relative to one another.

As a further aspect of the present invention, the height of the hanger's opening is sized to accommodate the width of the hanger's clip, but the width of the hanger's opening can not accommodate the clip.

As an additional aspect, the hook portion, the body portion and the stem portion of the hanger are formed as an integral unit.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF CERTAIN PREFERRED EMBODIMENTS

Figure 1:
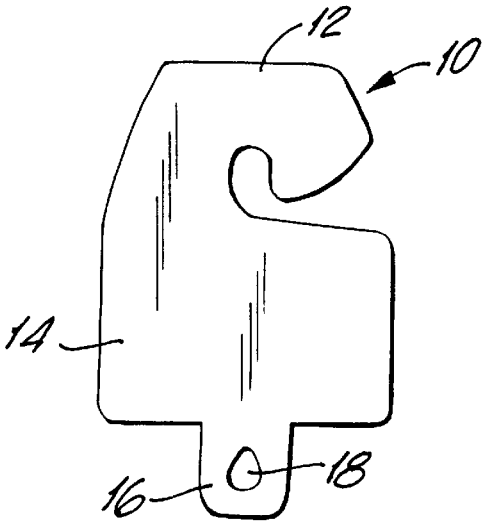
FIG. 1 is a schematic illustration of the hanger of the present invention.
Figure 2:
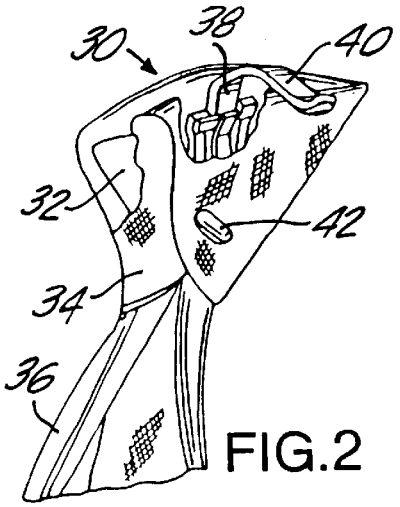
FIG. 2 is a partial, perspective view of a pre-tied knotted necktie assembly that may utilized with the present invention.

Referring to the drawings, and particularly to FIG. 1, there is shown a hanger 10 constructed in accordance with the present invention intended for use with a pre-tied knotted necktie assembly 30, such as shown in FIG. 2. Hanger 10 is formed having an upper hook portion 12, a central body portion 14, and lower stem portion 16. In the preferred embodiment, these portions are formed as an integral unit with hook portion 12 connected to body portion 14 which, in turn, is connected to stem portion 16.

Hanger 10 may be regarded as a flat sheet-like member having a constant thickness throughout its various portions. Of course, variations in thickness may be appropriate. Hanger 10 preferably is formed of a plastic composition, such as polyethylene or styrene, or a mixture of both said compositions, or other suitable plastic hanger material. This provides a product which is fairly tough to resist breakage and yet has some measure of flexibility for use as a hanger. That is, hook portion 12 is easily manipulated to engage and be suspended from a stationary bar or other display fixture.

Stem portion 16 is formed having an opening 18 disposed and sized to restrictively permit passage therethrough of the free end of a clip member which forms part of the necktie assembly 30 in a manner hereinafter described. As shown in the enlarged partial view of hanger 10 shown in FIG. 3, opening 18 is somewhat bell-shaped with the height of the opening, represented by dimension "a," being just slightly larger than the greatest width of clip end 40 of necktie assembly 30, further discussed below. The height of the opening is also larger than the width of the opening, represented by dimension "b," which in turn is just smaller than the greatest width of clip end 40. As will be further discussed, the particular dimensions of opening 18 facilitate the above-indicated objects of the present invention.

Hanger 10 also may be regarded as having front and rear surfaces on which marking indicia (not shown) such as the vendor's name and price, etc., may be placed.

Necktie assembly 30 shown in FIG. 2 corresponds, for example, to the necktie knot support assembly disclosed in U.S. Pat. No. 4,337,539, which is incorporated herein by reference. Another appropriate necktie assembly that may be utilized is disclosed in application Ser. No. 09/124,382, previously mentioned, which also is incorporated herein by reference.

Assembly 30 comprises a main body member 32 shaped to determine formation of a knot 34 of a necktie 36, and a spring clamp 38 adapted to interengage with body member 32. Spring clamp 38 has the previously mentioned clip end 40 and is disposed for pivotal movement between a retaining or lowered position (see FIGS. 8 and 9, discussed below), and a disengaging or raised position (shown in FIG. 2). Spring clamp 38 is provided for removably mounting necktie assembly 30 onto the neckband of shirt collar in the manner taught by the patent.

Figure 8:
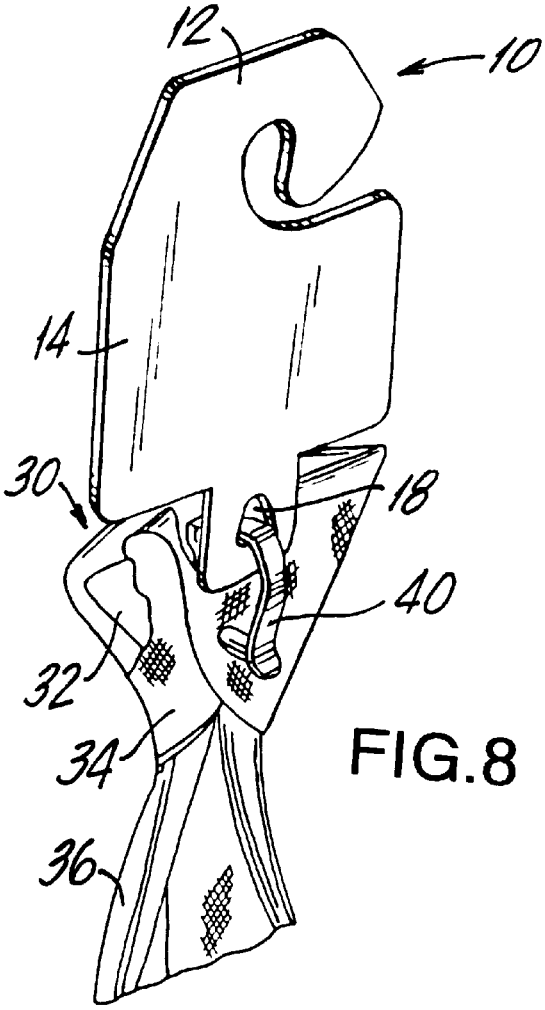
FIG. 8 is a perspective view of the hanger fully mounted to the necktie assembly when the necktie assembly is in its engaged position.

Necktie assembly 30 further includes a post 42 formed as part of body member 32 which extends outwardly from the rear surface of said body member. Post 42, as shown in FIG. 2, extends through the necktie knot 34 to aid in positioning the necktie 36 on the body member 32. Of course, the hanger of the present invention may be utilized with a necktie assembly that does not include a post, such as shown in FIG. 8 of application Ser. No. 09/124,382.

Figure 5:
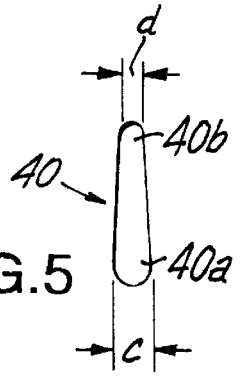
FIG. 5 schematically illustrates the varying width of the necktie assembly's clip.
Figure 6:
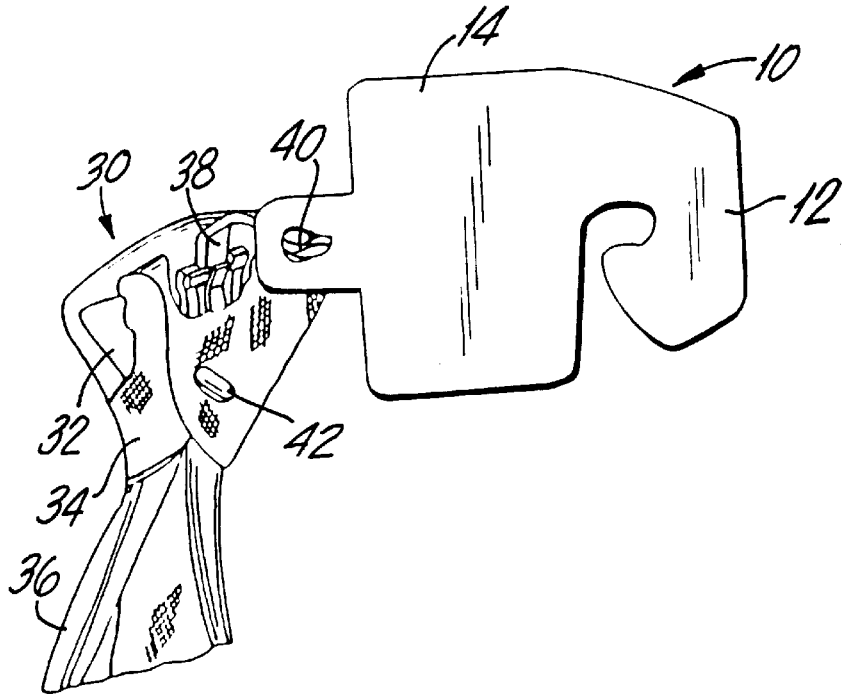
FIG. 6 is a perspective view of the hanger when partially mounted to the necktie assembly.

Hanger 10 and necktie assembly 30 are mounted together in the manner discussed below and with reference to FIGS. 4–9. First, clip end 40 of spring clamp 38 of the necktie assembly is moved to its disengaging position, as shown in FIG. 2. Next, hanger 10 and necktie assembly 30 are positioned in the manner shown in FIG. 4, wherein hanger 10 overlies the rear surface of necktie knot 34, with hanger 10 and necktie assembly 30 being aligned approximately 90° relative to one another (with respect to their completed, connected position—discussed below). FIG. 5 illustrates the general width of a typical clip end, such as clip end 40 discussed herein, and as shown, clip end 40 has a non-constant width with its widest width at its tip 40*a* and its smallest width at a location 40*b*, which is located near the necktie when formed on necktie assembly 30 (see FIG. 4). In accordance with the present invention, tip 40*a* of clip end 40 has a width "c" that is just slightly smaller than height "a" of opening 18 of hanger 10 (see FIG. 3), but that is wider than width "b" of opening 18. Given these relative dimensions, necktie assembly 30 can be connected to hanger 10 by aligning these two components 90° relative to one another, as mentioned above, and then causing clip end 40 to pass through opening 18 of the hanger. Since height "a" of hanger 10 is slightly larger than the width of clip end 40, even at its greatest width at tip 40*a* (i.e., dimension "c"), connection is possible. FIG. 6 schematically illustrates the relative positions of hanger 10 and assembly 30 at this point.

Figure 7:
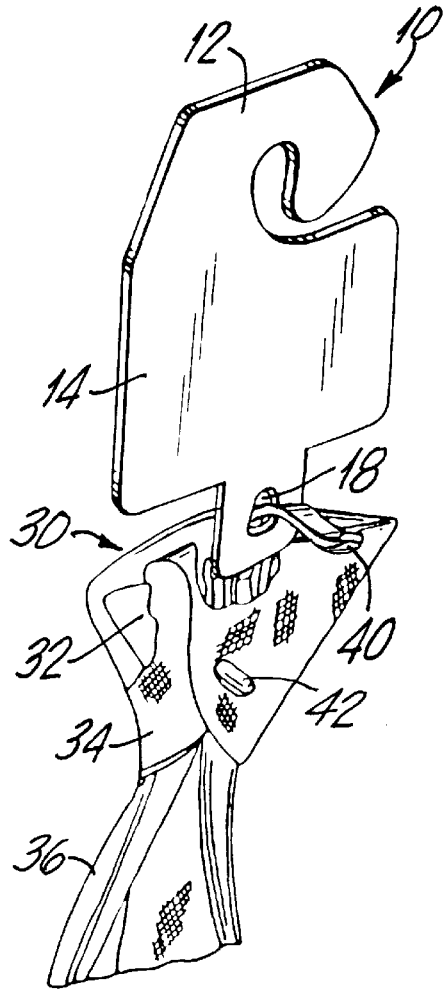
FIG. 7 is a perspective view of the hanger mounted to the necktie assembly after the hanger is rotated.
Figure 9:
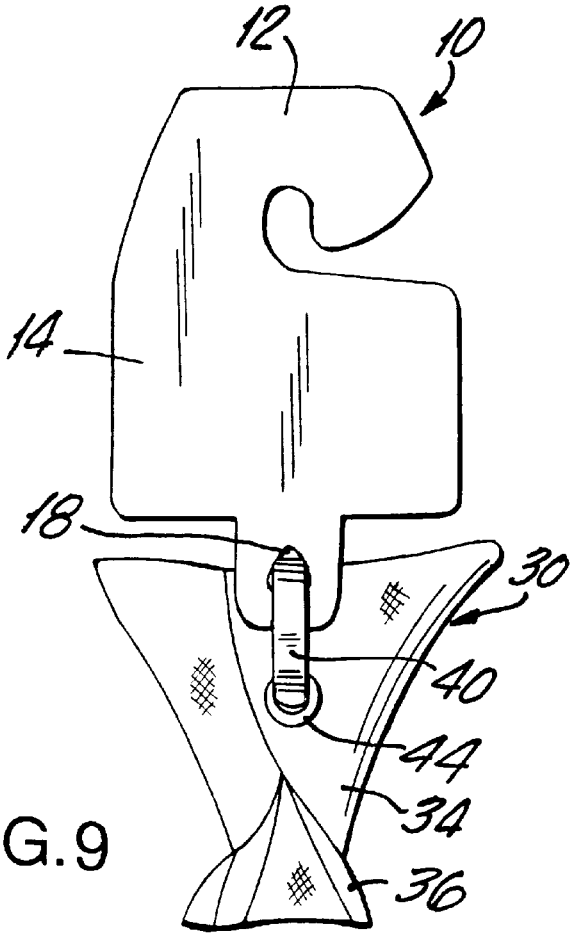
FIG. 9 is a rear view of the hanger fully mounted to the necktie assembly when the necktie assembly is in its engaged position.

Clip end 40 is moved further through opening 18 until lower stem portion 16 of hanger 10 is nearly touching the necktie formed on assembly 30, at which point the width of clip end 40 is sufficiently small so that hanger 10 can be rotated 90° about clip end 40. When hanger 10 is rotated 90°, the hanger and necktie assembly are vertically aligned, as shown in FIG. 7. As previously mentioned, width "d" of location 40*b* of clip end 40 (FIG. 5) is smaller than width "b" of opening 18 of hanger 10 (FIG. 3) and, thus, hanger 18 can accommodate rotation of clip end 40 therein. Of course, the position of location 40*b* need not be precise and merely represents any position of clip end 40 about which hanger 10 can rotate. Now, after hanger 10 and necktie assembly 30 are aligned, spring clamp 38 is placed to its retaining position by moving clip end 40 downward into contact with post 42, as shown in FIGS. 8 and 9. The hanger and attached necktie assembly now are ready for hanging on a stationary bar or other display fixture.

The attached components can be easily disconnected by reversing the steps described above. That is, to disconnect the necktie assembly from its hanger, spring clamp 38 is moved to its disengaged position by lifting clip end 40 (FIG. 7), hanger 10 and necktie assembly 30 are rotated 90° relative to one another and clip end 40 is removed from opening 18 of hanger 10.

Figure 3:
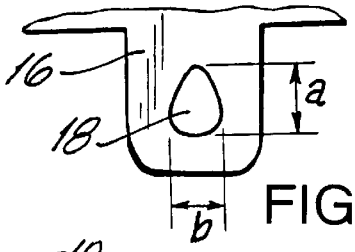
FIG. 3 is a partial, enlarged view of the hanger of the present invention.
Figure 4:
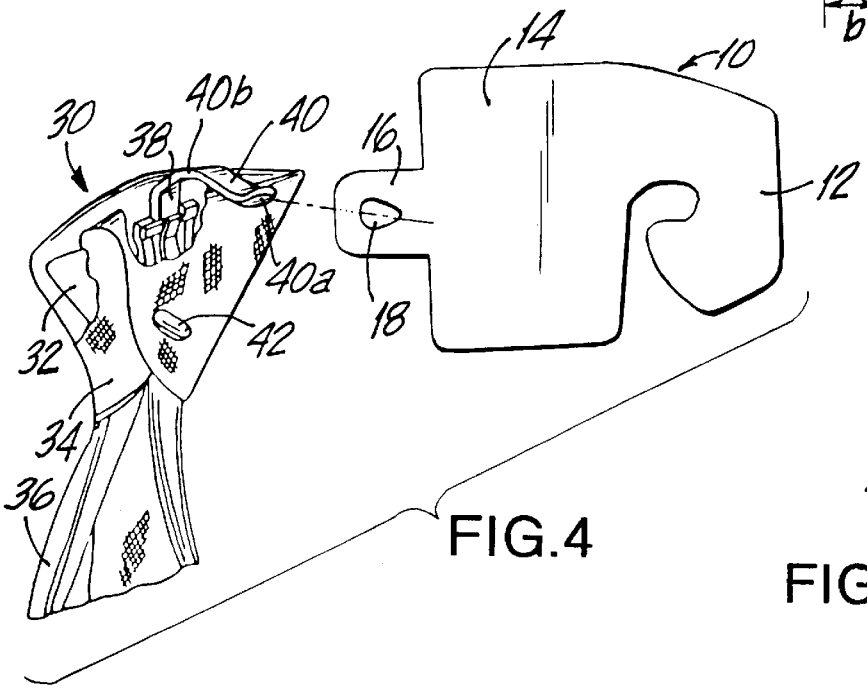
FIG. 4 is a perspective view of the hanger of the present invention together with a view of a pre-tied knotted necktie assembly showing the hanger in position to be mounted to the assembly.

As is appreciated, when hanger 10 and necktie assembly 30 are fully connected in the manner described above, hanger 10 cannot be disconnected by merely holding the necktie assembly and pulling hanger 10 therefrom. Since the width "b" of opening 18 of the hanger is sufficiently smaller than the greatest width (in the preferred embodiment, at tip 40*a*) of clip end 40, the clip end cannot be freed from the hanger. But such is possible after the hanger and the necktie assembly are rotated 90° relative to another. Moreover, to facilitate rotation of the hanger about the clip end, opening 18 has a curved structure as shown in FIG. 3, but other opening structures are possible to serve the same purpose.

Figure 10:
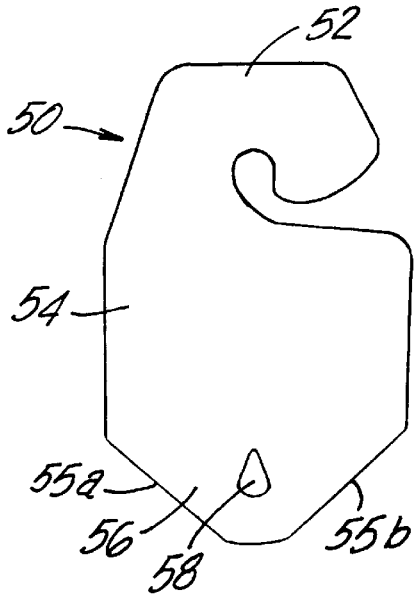
FIG. 10 is a schematic illustration of a hanger in accordance with another embodiment of the present invention.

FIG. 10 illustrates another hanger 50 in accordance with the present invention. Hanger 50 is similar to hanger 10 discussed above and includes an upper hook portion 52, a central body portion 54, a lower stem portion 56 and an opening 58. Central body 54 and lower stem portion 56 may be considered to be a single element. Hanger 50 also includes slanted surfaces 55*a* and 55*b* which tend to protrude into and "grab" the material of the necktie tied onto the necktie assembly when the hanger and necktie assembly are assembled in the above described manner. Such grabbing provides further support of the necktie assembly on hanger 50.

Figure 11:
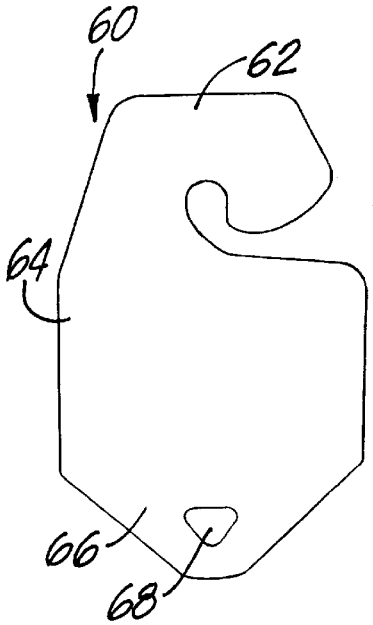
FIG. 11 is a schematic illustration of a hanger in accordance with a further embodiment of the present invention.
Figure 12:
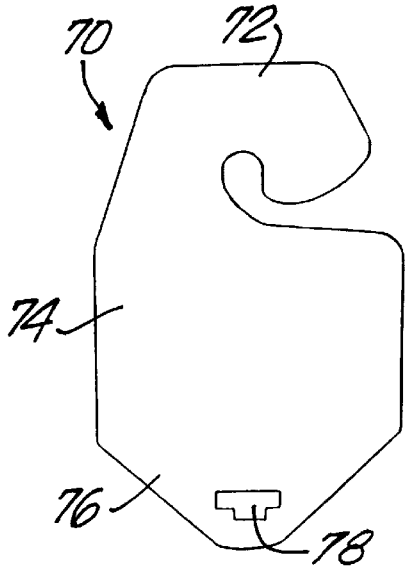
FIG. 12 is a schematic illustration of a hanger in accordance with yet another embodiment of the present invention.

FIGS. 11 and 12 illustrate alternative hanger designs of the present invention. Hanger 60 in FIG. 11 and hanger 70 in FIG. 12 are fundamentally similar. Hanger 60 includes an upper hook portion 62, a central body portion 64, a lower stem portion 66 and an opening 68. Similarly, hanger 70 includes an upper hook portion 72, a central body portion 74, a lower stem portion 76 and an opening 78. Although hangers 60 and 70 appear quite similar to hangers 10 and 50 previously discussed, their operation of use is quite different than that previously described. Namely, to assemble a necktie assembly onto either hanger 60 or hanger 70, the clip end of a necktie assembly (e.g., clip end 40 shown in FIG. 2) is inserted through the top portion of the respective opening 68, 78. When most of the clip end has passed through the hanger's opening, the width of the clip end located directly within the opening is sufficiently small so that the clip end may be moved into the lower portion of the hanger's opening. The assembly's spring clamp is engaged by lowering the clip end onto the assembly's post. The necktie assembly now is sufficiently retained by the hanger (60, 70) and can only be released by raising the clip end into the upper region of the hanger's opening (68, 78).

While the present invention has been particularly shown and described in conjunction with preferred embodiments thereof, it will be readily appreciated by those of ordinary skill in the art that various changes may be made without departing from the spirit and scope of the invention. For example, particular shapes of the various components of the hanger of the present invention have been provided, but other suitable shapes may be utilized.

Therefore, it is intended that the appended claims be interpreted as including the embodiments described herein, the alternatives mentioned above, and all equivalents thereto.

What is claimed is:

1. A pre-tied knotted necktie assembly and hanger combination, comprising:

a pre-tied knotted necktie assembly including a necktie, a knot support on which the necktie is pre-tied to form a necktie knot, and a clip for removably mounting the necktie assembly onto a neckband of a shirt collar; and a hanger having an upper hook portion, a central body portion coupled to said upper hook portion, and a lower stem portion coupled to said central body portion, said lower stem portion including an opening therethrough, said clip of said assembly being received within and selectively retained by said opening of said lower stem portion of the hanger, said opening through said lower stem portion being sized to receive the clip when the clip is disposed at a first orientation relative to said hanger, but not to receive the clip when the clip is disposed at a second orientation relative to said hanger, and to retain the received clip when the clip is disposed at the second orientation relative to said hanger, said first and second orientations being substantially different.

2. The combination of claim 1, wherein said first orientation and said second orientation are offset from one another by 90°.

3. The combination of claim 1, wherein the clip includes a clip end having a clip end width and a clip body having a clip body width smaller than said clip end width, and said opening through said lower stem portion has an opening width smaller than said clip end width but larger than said clip body width, and said lower step portion has an opening height larger than said clip end width.

4. A pre-tied knotted necktie assembly and hanger combination, comprising:

a pre-tied knotted necktie assembly including a necktie, a knot support on which the necktie is pre-tied to form a necktie knot, and a clip for removably mounting the necktie assembly onto a neckband of a shirt collar; and a hanger having an upper hook portion, a central body portion coupled to said upper hook portion, and a lower stem portion coupled to said central body portion, said lower stem portion including an opening therethrough, said opening being substantially T-shaped having a top portion with a width larger than a bottom portion, said clip of said assembly being received within and selectively retained by said opening of said lower stem portion of the hanger, said top portion of said opening being adapted to receive the clip, said bottom portion of said opening being adapted to retain the clip.

5. The combination of claim 1, wherein said hook portion, said body portion and said stem portion of said hanger are formed as an integral unit.

6. A method of attaching a hanger to a pre-tied knotted necktie assembly having a necktie, a knot support to form a necktie knot, and a clip for removably mounting the necktie assembly onto a neckband of a shirt collar, the hanger having an upper hook portion, a central body portion coupled to said upper hook portion, and a lower stem portion coupled to said central body portion and including an opening therethrough adapted to receive and selectively retain the clip, said method comprising the steps of:

aligning the clip of the assembly at a first orientation relative to the hanger;

sliding the clip through the opening of the lower stem portion of the hanger; and turning the clip relative to the hanger a predetermined amount, said predetermined amount being 90°.

7. The method of claim 6, further comprising the steps of moving the clip on the assembly to a disengaged position prior to aligning the clip; and moving the clip to an engaged position after turning the clip.

8. A method of attaching a hanger to a pre-tied knotted necktie assembly having a necktie, a knot support to form a necktie knot, and a clip for removably mounting the necktie assembly onto a neckband of a shirt collar, the hanger having an upper hook portion, a central body portion coupled to said upper hook portion, and a lower stem portion coupled to said central body portion and including an opening therethrough adapted to receive and selectively retain the clip, said method comprising the steps of:

aligning the clip of the assembly relative to the hanger by positioning the clip and assembly 90° relative to another;

sliding the clip through the opening of the lower stem portion of the hanger; and turning the clip relative to the hanger a predetermined amount.

9. The method of claim 6, wherein the clip includes a clip end having a clip end width and a clip body having a clip body width smaller than said clip end width, and said opening through said lower stem portion has an opening width smaller than said clip end width but larger than said clip body width, and said lower step portion has an opening height larger than said clip end width; and said step of sliding the clip is carried out by sliding the clip through the opening of the lower stem portion of the hanger until the clip body of the clip is located within the opening of the lower stem portion.

10. The combination of claim 1, wherein said opening through said lower stem portion is sized to receive the clip only when the clip is disposed at said first orientation relative to said hanger.

11. The combination of claim 10, wherein said first orientation and said second orientation are offset from one another by 90°.

* * * * *